United States Patent [19]

Maskasky

[11] Patent Number: 4,713,323

[45] Date of Patent: Dec. 15, 1987

[54] CHLORIDE CONTAINING TABULAR GRAIN EMULSIONS AND PROCESSES FOR THEIR PREPARATION EMPLOYING A LOW METHIONINE GELATINO-PEPTIZER

[75] Inventor: Joe E. Maskasky, Rochester, N.Y.

[73] Assignee: Eastman Kodak Company, Rochester, N.Y.

[21] Appl. No.: 15,405

[22] Filed: Feb. 17, 1987

Related U.S. Application Data

[63] Continuation of Ser. No. 811,132, Dec. 19, 1985, abandoned.

[51] Int. Cl.[4] ..... G03C 1/02; G03C 1/76; G03C 5/26

[52] U.S. Cl. ..... 430/569; 430/434; 430/495; 430/496; 430/564; 430/567

[58] Field of Search ..... 430/567, 569, 495, 496, 430/564, 434

[56] References Cited

U.S. PATENT DOCUMENTS

| | | | |
|---|---|---|---|
| 2,890,215 | 6/1959 | Corben | 430/642 X |
| 4,399,215 | 8/1983 | Wey | 430/569 |
| 4,400,463 | 8/1983 | Maskasky | 430/567 |

FOREIGN PATENT DOCUMENTS

| | | |
|---|---|---|
| 1449902A | 6/1985 | European Pat. Off. . |
| 58/70221 | 4/1983 | Japan . |
| 59/195232 | 11/1984 | Japan . |
| 245456 | 6/1925 | United Kingdom . |

OTHER PUBLICATIONS

*Research Disclosure,* vol. 176, Dec., 1978, Item 17643, Section IX, Vehicles & Vehicle Extenders.

Moll, "Investigations of Oxidized Gelatins", 2nd Photographic Gelatin Symposium, sponsored by the Royal Photographic Society, Oxford, United Kingdom, Sep. 6, 1985.

*Research Disclosure,* vol. 225, Jan. 1983, Item 22534.

J. Pouradier & A. Rondeau, "On the Methionine Sulphoxide of Gelatin", *The Journal of Photographic Science,* vol. 16, 1968, pp. 68 & 69.

Y. Matsuo, "Degradation of Methionine by Hydrogen Peroxide", *Nature,* vol. 171, p. 1021, 1953.

J. Beersman, "Proceedings of the International Colloquium Held at Liege 1959", *Scientific Photography,* Macmillan, pp. 321 & 322.

W. D. Kelly, "Purification and Chemical Sensitization of Photographic Gelatin", *The Journal of Photographic Science,* vol. 6, pp. 16–22, 1958.

*Primary Examiner*—John E. Kittle
*Assistant Examiner*—Mukund J. Sham
*Attorney, Agent, or Firm*—Carl O. Thomas

[57] ABSTRACT

The present invention is directed to a process of precipitating for use in photography a high aspect ratio tabular grain emulsion employing a dispersing medium containing a gelatino-peptizer comprised of less than 30 micromoles of methionine per gram and at least a 0.5 molar concentration of chloride ion. A wide range of chloride ion concentrations in the tabular grains can be achieved while avoiding the use of tabular grain thickening ripening agents and synthetic peptizers.

30 Claims, 6 Drawing Figures

5μm

CHLORIDE CONTAINING TABULAR GRAIN EMULSIONS AND PROCESSES FOR THEIR PREPARATION EMPLOYING A LOW METHIONINE GELATINO-PEPTIZER

FIELD OF THE INVENTION

The invention relates to processes for the precipitation of radiation sensitive tabular grain emulsions useful in photography and to chloride containing emulsions produced thereby.

BACKGROUND OF THE INVENTION

The most commonly employed photographic elements are those which contain a radiation sensitive silver halide emulsion layer coated on a support. Although other ingredients can be present, the essential components of the emulsion layer are radiation sensitive silver halide microcrystals, commonly referred to as grains, which form the discrete phase of the photographic emulsion, and a vehicle, which forms the continuous phase of the photographic emulsion.

It is important to recognize that the vehicle encompasses both the peptizer and the binder employed in the preparation of the emulsion layer. The peptizer is introduced during the precipitation of the grains to avoid their coalescence or flocculation. Peptizer concentrations of from 0.2 to 10 percent, by weight, based on the total weight of emulsion as prepared by precipitation, can be employed.

It is common practice to maintain the concentration of the peptizer in the emulsion as initially prepared below about 6 percent, based on total emulsion weight, and to adjust the emulsion vehicle concentration upwardly for optimum coating characteristics by delayed binder additions. For example, the emulsion as initially prepared commonly contains from about 5 to 50 grams of peptizer per mole of silver, more typically from about 10 to 30 grams of peptizer per mole of silver. Binder can be added prior to coating to bring the total vehicle concentration up to 1000 grams per mole of silver. The concentration of the vehicle in the emulsion layer is preferably above 50 grams per mole of silver. In a completed silver halide photographic element the vehicle preferably forms about 30 to 70 percent by weight of the emulsion layer. Thus, the major portion of the vehicle in the emulsion layer is typically not derived from the peptizer, but from the binder that is later introduced.

While a variety of hydrophilic colloids are known to be useful peptizers, preferred peptizers are gelatin—e.g., alkali-treated gelatin (cattle bone or hide gelatin) or acid-treated gelatin (pigskin gelatin)—and gelatin derivatives—e.g., acetylated gelatin or phthalated gelatin. Gelatin and gelatin derivative peptizers are hereinafter collectively referred to as "gelatino-peptizers".

Materials useful as peptizers, particularly gelatin and gelatin derivatives, are also commonly employed as binders in preparing an emulsion for coating. However, many materials are useful as vehicles, including materials referred to as vehicle extenders, such as latices and other hydrophobic materials, which are inefficient peptizers. A listing of known vehicles is provided by *Research Disclosure,* Vol. 176, December 1978, Item 17643, Section IX, Vehicles and vehicle extenders. *Research Disclosure* is published by Kenneth Mason Publications, Ltd., Emsworth, Hampshire P010 7DD, England.

It has been recognized that when the gelatin incorporated in an emulsion layer of a photographic element is oxidized, modification of emulsion photographic properties can result. Corben U.S. Pat. No. 2,890,215 discloses the desensitization of gelatin by treatment with a peracid. Komatsu et al Japanese Kokai No. 58(1983)-70221 discloses improved keeping stability for internal latent image forming silver halide emulsions when oxidized gelatin is employed. Komatsu et al Japanese Kokai No. 59(1984)-195232 discloses improved storage stability for silver halide emulsions having silver chloride grain surfaces prepared using oxidized gelatin.

Moll, "Investigations of Oxidized Gelatins", 2nd Photographic Gelatin Symposium, sponsored by the Royal Photographic Society, Oxford, United Kingdom, Sept. 6, 1985, discloses that the chemical and physical properties of oxidized gelatins, including luminescence of emulsions prepared therefrom, do not differ substantially from those of the native gelatin. The sensitometry and growth restraining properties, however, are reportedly changed by the oxidation treatment. It is stated that these changes cannot be attributed to oxidation of methionine.

Mifune et al EPO No. 0,144,990 A2 discloses a process for controlled ripening of a silver halide emulsion with a sulfur containing silver halide solvent. An oxidizing agent is relied upon to terminate ripening of the emulsion once the desired extent of ripening is accomplished.

Chloride, bromide, and iodide are the halides from which silver halide grains are formed. The highest photographic speeds are realized with silver bromide grains, optionally containing a minor proportion of iodide. The incorporation of chloride in silver halide grains is recognized to be advantageous for a variety of photographic applications. For example, silver chloride exhibits less native absorption in the blue portion of the visible spectrum than the remaining silver halides and can therefore be used with green or red spectral sensitizing dyes to record green or red light more selectively. Further, silver chloride is more soluble than the other photographically useful silver halides, thereby permitting development and fixing to be achieved in shorter times. Radiation sensitive photographic emulsions having halide grains containing chlorlde as the sole halide or in combination with bromide and/or iodide are the preferred emulsions for producing photographic prints.

Recently the photographic art has turned its attention to high aspect ratio tabular grain emulsions, herein defined as those in which tabular grains having an aspect ratio greater than 8:1 account for greater than 50 percent of the total grain projected area. These emulsions can offer a wide variety of advantages, including reduced silver coverages, thinner emulsion layers, increased image sharpness, more rapid developability and fixing, higher blue and minus blue speed separations, higher covering power, improved speed-granularity relationships, reduced crossover, less reduction of covering power with full forehardening, as well as advantages in image transfer. *Research Disclosure,* Vol. 225, January 1983, Item 22534, is considered representative of these teachings.

In almost every instance the advantages of high aspect ratio tabular grain emulsions are enhanced by limiting the thickness of the tabular grains. High aspect ratio tabular grain silver bromide emulsions having tabular grain thicknesses well below 0.3 μm have been formed, and corresponding silver bromoiodide emulsions have been recently produced. High aspect ratio tabular grain emulsions the tabular grains of which are formed by chloride as the sole halide or in combination with bromide and/or iodide have been achieved with difficulty only by observing specific preparation requirements.

Wey U.S. Pat. No. 4,399,215 discloses the double jet precipitation of high aspect ratio tabular grain silver chloride emulsions. The process of preparation does not permit the initial presence of bromide or iodide ions and requires the presence of ammonia, a pAg in the range of from 6.5 to 10, and a pH in the range of from 8 to 10. While tabular grains are formed, the ripening action of the ammonia present during precipitation thickens the tabular grains. Thus, high aspect ratio tabular grain silver chloride emulsions prepared as taught by Wey are substantially greater than 0.35 μm in tabular grain thickness.

Maskasky U.S. Pat. No. 4,400,463 discloses a process of preparing high aspect ratio tabular grain emulsions, the halide content of which is at least 50 mole percent chloride, based on silver. The process disclosed requires the use of aminoazaindene as a growth modifier and a synthetic peptizer. The peptizers disclosed to be useful are water soluble linear copolymers comprising (1) recurring units in the linear polymer chain of amides or esters of maleic, acrylic, or methacrylic acids in which respective amine or alcohol condensation residues in the respective amides and esters contain an organic group having at least one sulfide sulfur atom linking two alkyl carbon atoms and (2) units of at least one other ethylenically unsaturated monomer. Otherwise comparable emulsions prepared with no peptizer or with only gelatin as a peptizer did not produce a tabular grain emulsion.

Wey et al U.S. Pat. No. 4,414,306 discloses a a process for preparing high aspect ratio tabular grain silver chlorobromide emulsions the chloride content of which can range as high as 40 mole percent, based on silver. This is achieved by maintaining a molar ratio of chloride to bromide ions in the reaction vessel of from 1.6:1 to 258:1 and maintaining the total concentration of halide ions in the reaction vessel in the range of from 0.10 to 0.90 normal.

Collectively these patents teach that high aspect ratio tabular grain emulsions containing chloride as the sole halide or in combination with other halides can be achieved by accepting one or a combination of (1) tabular grain thicknesses greater than 0.35 μm, (2) a synthetic peptizer other than gelatin, and (3) limiting the chloride to less than 40 mole percent of the total halide, based on silver.

SUMMARY OF THE INVENTION

In one aspect this invention is directed to a radiation sensitive high aspect ratio tabular grain emulsion comprised of a gelatino-peptizer and silver halide grains which are at least 40 mole percent chloride, based on silver, at least 50 percent of the total projected area of the silver halide grains being accounted for by tabular grains having a thickness of less than 0.35 μm and an aspect ratio greater than 8:1.

In another aspect this invention is directed to a process of preparing a radiation sensitive high aspect ratio tabular grain emulsion, wherein tabular grains of less than 0.35 μm in thickness and an aspect ratio of greater than 8:1 account for greater than 50 percent of the total grain projected area, comprising introducing silver ion into a dispersing medium containing at least a 0.5 molar concentration of chloride ion and a gelatino-peptizer formed of less than 30 micromoles of methionine per gram.

It is an advantage of the present invention that high aspect ratio tabular grain emulsions are provided which (1) can contain any desired proportion of chloride ion, (2) contain a gelatino-peptizer and do not require the use of a synthetic peptizer, and (3) have tabular grains of thickness of less than 0.35 μm. It is a more specific advantage of the present invention that a high aspect ratio tabular grain emulsion is provided the tabular grains of which are less than 0.35 μm in thickness and contain in excess of 40 mole percent chloride. It is another advantage of this invention that a novel high aspect ratio tabular grain emulsion preparation process is provided which can be used to prepare emulsions of widely differing halide content.

BRIEF DESCRIPTION OF THE DRAWINGS

These and other advantages of the invention can be better appreciated by consideration of the following detailed description of preferred embodiments in combination with the drawings, in which.

DESCRIPTION OF PREFERRED EMBODIMENTS

Figure 1:
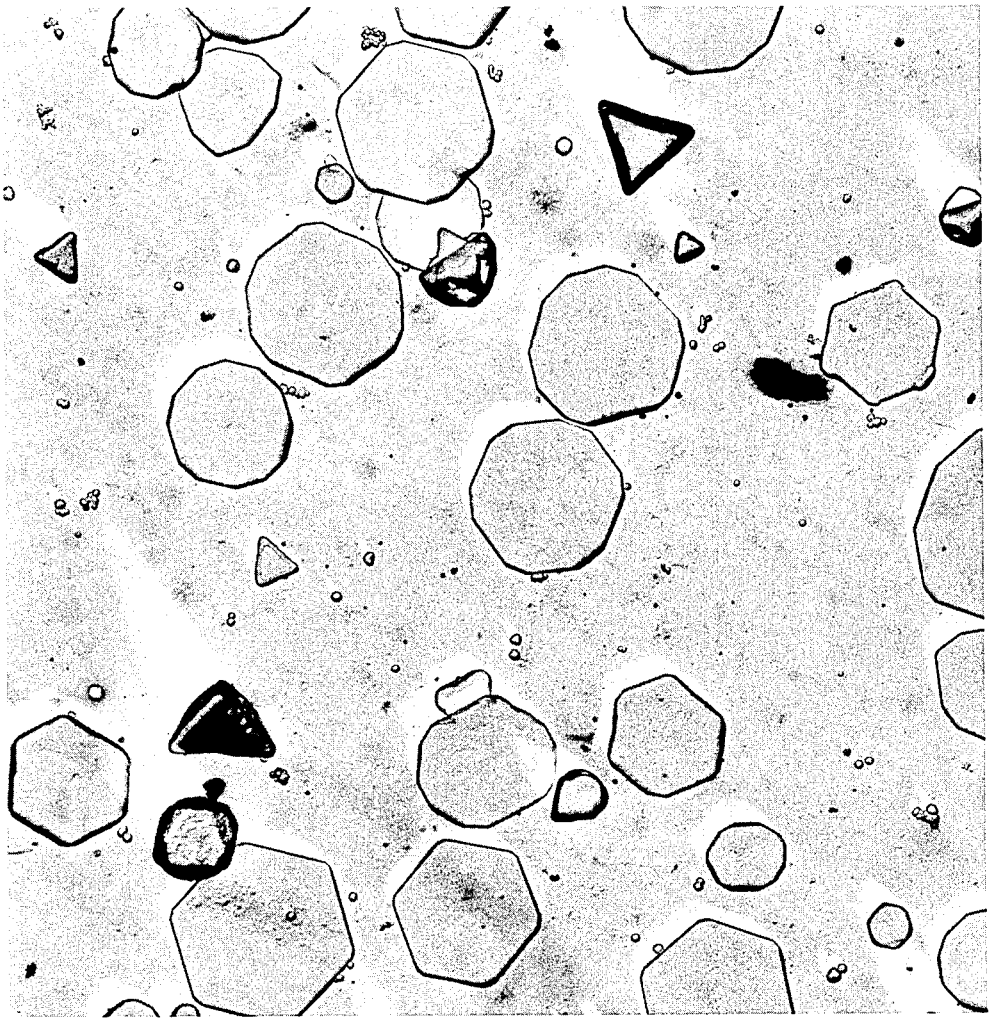
FIGS. 1, 3, 4, and 6 are electron micrographs of example emulsions

It has been discovered quite unexpectedly that silver halide emulsions in which tabular silver halide grains having a thickness of less than 0.35 μm and an aspect ratio of greater than 8:1 account for greater than 50 percent of the total grain projected area can be prepared by introducing silver ion into a reaction vessel containing at least a 0.5 molar concentration of chloride ion while employing a gelatino-peptizer containing less than 30 micromoles of methionine per gram of gelatin.

At the beginning of precipitation the chloride ion in the reaction vessel is at least 0.5 molar, but can range upwardly to the saturation level of the soluble salt used to supply the chloride ion. In practice it is preferred to maintain the chloride ion concentration below saturation levels to avoid elevated levels of viscosity of the aqueous solution in the reaction vessel. Preferred chloride ion concentration levels are in the range of from 0.5 to 2.0 molar, optimally from about 0.5 to 1.5 molar.

The chloride ion can be provided by any soluble chloride salt known to be useful in grain precipitation. Alkali metal (e.g., lithium, sodium, or potassium) or alkaline earth metal (e.g., magnesium, calcium, or barium) can be employed as counter ions for the chloride ions. It is also possible to employ ammonium counter ions; however, when ammonium ions are employed, the pH is kept on the acid side on neutrality to avoid the presence of ammonia, which acts as a ripening agent and contributes to thickening the tabular grains.

By placing sufficient chloride ion initially in the reaction vessel to react with silver ion introduced while still maintaining the concentration of chloride ion in the reaction vessel above 0.5 molar, it is possible to prepare high aspect ratio tabular grain emulsions according to this invention without the further addition of halide ion. That is, high aspect ratio tabular grain silver chloride emulsions according to this invention can be prepared by single jet precipitation merely by introducing a conventional water soluble silver salt, such as silver nitrate.

It is, of course, possible to introduce additional chloride ion into the reaction vessel as precipitation progresses. This has the advantage of allowing the chloride concentration level of the reaction vessel to be maintained initially at or near the optimum molar concentration level. Thus, double jet precipitation of high aspect ratio tabular grain silver chloride emulsions is contemplated. Conventional aqueous chloride salt solutions containing counter ions as identified above can be employed for the chloride ion jet.

Since silver bromide and silver iodide are markedly less soluble than silver chloride, it is appreciated that bromide and/or iodide ions if introduced into the reaction vessel will be incorporated in the grains in preference to the chloride ions. Thus, by employing bromide or iodide salts corresponding to the chloride salts described above in combination with the chloride ions, it is possible to prepare high aspect ratio tabular grain emulsions in which the tabular grains also contain one or more other halides or even contain no measurable amounts of chloride. For example, a high aspect ratio tabular grain emulsion has been prepared according to this invention in which 100 mole percent bromide is present, based on silver. High aspect ratio tabular grain emulsions have also been prepared in which both chloride and bromide ions are present in the grains. Thus, high aspect ratio tabular grain emulsions ranging from those containing chloride as the sole halide to those containing bromide as the sole halide as well as all intermediate proportions of chloride and bromide are made possible by this invention. It is to be noted that this makes possible for the first time the ability to prepare a high aspect ratio tabular grain chlorobromide emulsion which contains from 40 to 50 mole percent chloride, based on silver.

The preferred high aspect ratio tabular grain emulsions according to the present invention are those which contain at least a small amount of bromide in addition to chloride. It has been observed quite unexpectedly that the presence of bromide at the outset of precipitation results in much thinner tabular grains. Tabular grain thicknesses of less than 0.3 $\mu$m have been realized when bromide ion is also present at the outset of grain precipitation. Since bromide ion enters the grains being formed more rapidly than chloride ions, only very low concentrations of bromide ions are required to produce observable thinning of the tabular grains. It is preferred to employ a bromide ion concentration in the reaction vessel prior to silver ion introduction of at least $2.5\times10^{-3}$M. To increase the concentration of the bromide in the tabular grains the concentration of bromide ions in the reaction vessel can be increased or additional bromide ions can be introduced while precipitation is occurring. As demonstrated by the examples, high aspect ratio tabular grain silver chlorobromide emulsions having tabular grain thicknesses of 0.2 $\mu$m and less have been formed according to this invention containing as little as 0.5 mole percent bromide, based on silver.

It has been further demonstrated that the practice of this invention is compatible with the incorporation of minor amounts of iodide in the tabular grains, preferably up to about 1 mole percent or less, based on silver. Iodide ion is preferably incorporated into the tabular grains by introducing iodide ion into the reaction vessel while precipitation is occurring.

Silver chloride favors the formation of {100} crystal faces, which are incompatible with the desired {111} crystal faces needed for tabular grain formulation. To insure that tabular grains are formed when silver chloride is being precipitated, a grain growth modifier is employed. Any one of the grain growth modifiers disclosed by Maskasky U.S. Pat. No. 4,400,463 can be employed for this purpose, the disclosure of which is here incorporated by reference. While small quantities of iodide ion can act as a growth modifier, it is generally preferred to employ an aminoazaindene. Specifically preferred aminoazaindenes for use in the practice of this invention are those having a primary amino substituent attached to a ring carbon atom of a tetraazaindene, such as adenine and guanine, also referred to as aminopurines. While aminoazaindenes can be employed in concentrations as high as 0.1 mole per mole of silver, as taught by Maskasky U.S. Pat. No. 4,400,463, cited above, it is a surprising feature of this invention that aminoazaindene concentrations of an order of magnitude less than those of Maskasky U.S. Pat. No. 4,400,463 are effective. Useful aminoazaindene concentrations as low as $10^{-4}$ mole per mole of silver are effective. It is generally preferred to maintain from about $0.5\times10^{-3}$ to $5\times10^{-3}$ mole of aminoazaindene per mole of silver in the reaction vessel during precipitation.

Once the emulsion is formed the aminoazaindene is no longer required, but at least a portion typically remains adsorbed to the grain surfaces. Compounds which show a strong affinity for silver halide grain surfaces, such as spectral sensitizing dyes, may displace the aminoazaindene, permitting the aminoazaindene to be substantially entirely removed from the emulsion by washing. Since azaindenes are well known as excellent antifoggants, their retention in the emulsions as formed can be advantageous.

In addition to the 0.5 molar chloride ion concentration in the reaction vessel, it is additionally contemplated to employ a gelatino-peptizer containing a low level of methionine.

Gelatino-peptizers are made up of or derived from proteins. While approximately twenty amino acids are known to make up proteins, methionine is the amino acid which is principally responsible for the divalent sulfur atoms in gelatino-peptizers. It is observed that organic compounds containing divalent sulfur atoms show a strong affinity for grain surfaces. Thus, methionine has a strong influence on the properties of gelatino-peptizers.

It is demonstrated in the examples below that the use of gelatino-peptizers containing methionine in concentrations of less than 30 micromoles per gram produce high aspect ratio tabular grain emulsions, whereas comparable precipitations using conventional gelatin, containing higher levels of methionine, does not produce high aspect ratio tabular grain emulsions. The gelatino-peptizers employed in the preparation of high aspect tabular grain emulsions according to this invention preferably have a merhionine concentration of less than 12 micromoles per gram of gelatin and optimally have a methionine concentration of less than 5 micromoles per gram.

Gelatin is globally derived from animal protein—typically, animal hides and bones, and there are variations attributable to geographic and animal sources as well as preparation procedures in the levels of methionine found in gelatin and its derivatives used as photographic peptizers. In rare instances gelatin as initially prepared is low in methionine and requires no special treatment to realize the less than 30 micromoles of methionine per gram criterion of this invention; but normally gelatin as initially prepared contains far in excess of the desired 30 micromoles of methionine per gram. These gelatino-peptizers can be modified to satisfy the low methionine requirements of this invention by treatment with an oxidizing agent. Further, even when employing gelatins which naturally contain low levels of methionine, methionine is still present in higher than optimum levels and can be improved for use in the practice of this invention by treatment with an oxidizing agent. While any of a variety of known strong oxidizing agents can be employed, hydrogen peroxide is a preferred oxidizing agent, since it contains only hydrogen and oxygen atoms. Appropriate levels of oxidizing agent are readily determined knowing the initial concentration of methionine in the gelatino-peptizer to be treated. An excess of oxidizing agent can be employed without adverse effect.

The oxidizing agent treatment of gelatino-peptizers eliminates or lowers the concentration of the methionine by oxidizing the divalent sulfur atom in the molecule. Thus, the divalent sulfur atoms are partially oxidized to tetravalent sulfinyl or fully oxidized to hexavalent sulfonyl groups. It is believed that gelatino-peptizers containing less than 30 micromoles per gram of methionine are less tightly adsorbed to the peptized grain surfaces by reason of the reduced presence of divalent sulfur atoms in the peptizer.

Subject to methionine level requirements set forth above, the preferred gelatino-peptizer for use in the practice of this invention is gelatin. Of the various modified forms of gelatin, acetylated gelatin and phthalated gelatin constitute preferred gelatin derivatives. Specific useful forms of gelatin and gelatin derivatives can be chosen from among those disclosed by Yutzy et al U.S. Pat. Nos. 2,614,928 and 2,614,929; Lowe et al U.S. Pat. Nos. 2,614,930 and 2,614,931; Gates U.S. Pat. Nos. 2,787,545 and 2,956,880; Ryan U.S. Pat. No. 3,186,846; Dersch et al U.S. Pat. No. 3,436,220; and Luciani et al U.K. Pat. No. 1,186,790.

Except for the distinguishing features discussed above, precipitations according to the invention can take conventional forms, such as those described by *Research Disclosure,* Vol. 176, December 1978, Item 17643, Section I, or U.S. Pat. Nos. 4,399,215; 4,400,463; and 4,414,306, cited above. Since very small grains can be held in suspension without a peptizer, peptizer can be added after grain formation has been initiated, but in most instances it is preferred to add at least 10 percent and, most preferably at least 20 percent, of the peptizer present at the conclusion of precipitation to the reaction vessel before grain formation occurs. The low methionine gelatino-peptizer is preferably the first peptizer to come into contact with the silver halide grains. Gelatino-peptizers with conventional methionine levels can contact the grains prior to the low methionine gelatino-peptizer, provided it is maintained below concentration levels sufficient to peptize the tabular grains produced. For instance, any gelatino-peptizers with a conventional methionine level of greater than 30 micromoles per gram initially present is preferably held to a concentration of less than 1 percent of the total peptizer employed. While it should be possible to use another type of peptizer toward the end of precipitation with minimal adverse impact on the emulsions, it is preferred that the low methionine gelatino-peptizer be used as the sole peptizer throughout the formation and growth of the high aspect ratio tabular grain emulsion.

Mignot U.S. Pat. No. 4,334,012, which is concerned with ultrafiltration during emulsion precipitation and here incorporated by reference, sets forth a variety of preferred procedures for 5 managing the introduction of gelatino-peptizer, silver, and halide ions during emulsion precipitations. For example, instead of introducing silver and halide ions as soluble salts as described above, they can alternatively be introduced into the reaction vessel in the form of a Lippmann emulsion.

Modifying compounds can be present during emulsion precipitation. Such compounds can be initially in the reaction vessel or can be added along with one or more of the peptizer and ions identified above. Modifying compounds, such as compounds of copper, thallium, lead, bismuth, cadmium, zinc, middle chalcogens (i.e., sulfur, selenium, and tellurium). gold. and Group VIII noble metals, can be present during precipitation, as illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,,950,972; Sidebotham U.S. Pat. No. 3,488,709; Rosecrants et al U.S. Pat. No. 3,737,313; Berry et al U.S. Pat. No. 3,772,031; Atwell U.S. Pat. No. 4,269,927; and *Research Disclosure,* Vol. 134, June 1975, Item 13452. It is also possible to introduce one or more spectral sensitizing dyes into the reaction vessel during precipitation, as illustrated by Locker et al U.S. Pat. No. 4,225,666.

It is important to note that once an emulsion has been prepared as described above any conventional vehicle, including gelatin and gelatin derivatives of higher methionine levels, can be introduced while still realizing all of the advantages of the invention. Other useful vehicle materials are illustrated by *Research Disclosure,* Item 17643, cited above, Section IX.

The emulsion which is produced by the above described preparation procedures is a high aspect ratio tabular grain emulsion comprised of vehicle and silver halide grains, at least 50 percent of the total projected area of the silver halide grains being accounted for by tabular grains having a thickness of less than 0.35 μm and an aspect ratio of greater than 8:1.

The aspect ratio of the grains is determined by dividing the grain thickness by the grain diameter. Grain diameter is its equivalent circular diameter—that is, the diameter of a circle having an area equal to the projected area of the grain. Grain dimensions can be determined from known techniques of microscopy.

The preferred emulsions prepared according to the present invention are those in which the tabular grains of a thickness of 0.2 μm or less and an aspect ratio of greater than 8:1 have an average aspect ratio of at least 12:1. As demonstrated in the examples, average aspect ratios of greater than 20:1 have been demonstrated and still higher aspect ratios are contemplated. The preferred emulsions are those in which the tabular grains account for greater than 70 percent of the total grain projected area. While the tabular grain projected area criterion can be met by the precipitation procedures set forth above, known grain separation techniques, such as differential settling and decantation, centrifuging, and hydrocyclone separation, can, if desired, be employed. An illustrative teaching of hydrocyclone separation is provided by Audran et al U.S. Pat. No. 3,326,641.

The thin tabular grain emulsions can be put to photographic use as precipitated, but are in most instances adapted to serve specific photographic applications by procedures well known in the art. Conventional hardeners can be used, as illustrated by *Research Disclosure,* Item 17643, cited above, Section X. The emulsions can be w.ashed following precipitation, as illustrated by Item 17643, Section 11. The emulsions can be chemically and spectrally sensitized as described by Item 17643, Sections III and IV; however, the emulsions are preferably chemically and spectrally sensitized as taught by Kofron et al U.S. Pat. No. 4,439,520, cited above. The emulsions can contain antifoggants and stabilizers, as illustrated by Item 17643, Section VI.

The emulsions of this invention can be used in otherwise conventional photographic elements to serve varied applications, including black-and-white and color photography, either as camera or print materials; image transfer photography; photothermography; and radiography. The remaining sections of *Research Disclosure,* Item 17643, illustrate features particularly adapting the photographic elements to such varied applications.

EXAMPLES

The invention can be better appreciated by reference to the following specific examples. In each of the examples the contents of the reaction vessel were stirred vigorously during silver salt introduction. Except as otherwise noted the gelatin employed as a starting material prior to hydrogen peroxide treatment, if any, contained approximately 55 micromoles of methionine per gram.

Grain characteristics of the various emulsions prepared in the examples were determined from photomicrographs and are summarized below in Table I. The heading "Thickness" refers to the mean thickness of the tabular grains measured in μm. The thickness was determined by the Jamin-Lebedeff optical microscopic method which is described in *The Particle Atlas,* by W. C. McCrane and J. G. Delly, Ann Arbor Publishers, Inc., Ann Arbor, Mich., 1973, 2nd Ed., Vol. 1, pp. 37–39. The heading "Mean ECD" refers to the tabular grain mean grain size reported in terms of mean effective circular diameter (ECD). The heading "Aspect Ratio" is the quotient of the "Mean ECD" divided by the "Thickness". The "% of Area Tabular" column represents a visual estimate of the % of total grain projected area accounted for by tabular grains having a thickness of less than 0.35 μm and an aspect ratio of greater than 8:1.

Example 1

This example illustrates the preparation of tabular grain AgCl or AgClBr emulsions of up to 57% AgBr by a single-jet precipitation at 70° C. Comparative emulsions are also prepared in which the grains are nontabular.

Example 1A

Tabular AgCl Emulsion

Oxidized gelatin was prepared was follows: To 500 g of 12.0% deionized bone gelatin was added 0.6 g of 30% $H_2O_2$ in 20 ml of distilled water. The mixture was stirred for 16 hours at 40° C., then cooled and stored for use.

The reaction vessel, equipped with a stirrer, was charged with 400 g of an aqueous solution containing 1% of oxidized gelatin (prepared as described above), 0.26 millimoles of adenine, and 0.5M in $CaCl_2.2H_2O$. The pH was adjusted to 4.0 at 70° C. and maintained at that value throughout the precipitation by addition of NaOH solution as required. A 2M $AgNO_3$ solution was added over a 1 min period at a rate consuming 1.0% of the total Ag used. The addition rate was then linearly accelerated over an additional period of 24 min (9.8× from start to finish) during which time the remaining 99.0% of the Ag was consumed. A total of 0.1 mole Ag was consumed in the precipitation.

FIG. 1 is a carbon replica electron micrograph of the resulting tabular grain AgCl emulsion. The grain characteristics of the emulsion are summarized in Table I.

Example 1B

Tabular AgClBr Emulsion (1.0% Br)

This emulsion was prepared as described in Example 1A, except that 0.001 mole NaBr was added initially to the reaction vessel solution.

The grain characteristics of the emulsion are summarized in Table I. It is apparent that the addition of only 1 mole percent bromide resulted in significant further thinning of the tabular grains.

Example 1C

Tabular AgClBr Emulsion (58.5% Br)

The reaction vessel equipped with a stirrer was charged with 400 g of an aqueous solution identical to that of Example 1A, but with the further addition of 1.0 millimole NaBr. The pH was maintained at 4.0 at 70° C. as in Example 1B. Over a period of 2 min a 2M solution of $AgNO_3$ was added at a uniform rate consuming 2.0% of the total Ag used. Addition of the $AgNO_3$ was then continued at a linearly accelerating rate over a period of 24 min (9.8× from start to finish) during which time the remaining 98% of the total Ag was added. Beginning after the first 2 min of $AgNO_3$ addition, a 4.60M solution of NaBr was added at one-quarter the flow rate of the $AgNO_3$ addition. A total of 0.10 mole Ag was consumed in the precipitation.

The grain characteristics of the emulsion are summarized in Table I. It is apparent that the addition of 58.5 mole percent bromide as compared to 1.0 mole percent in Example 1B had little effect on the tabular grain population obtained.

Control 1D

AgClBr (1.0% Br) Comparison Emulsion

This emulsion was prepared as described in Example 1B, except that the gelatin used as peptizer was not oxidized and contained 56 micromoles methionine per gram gelatin.

Figure 2:
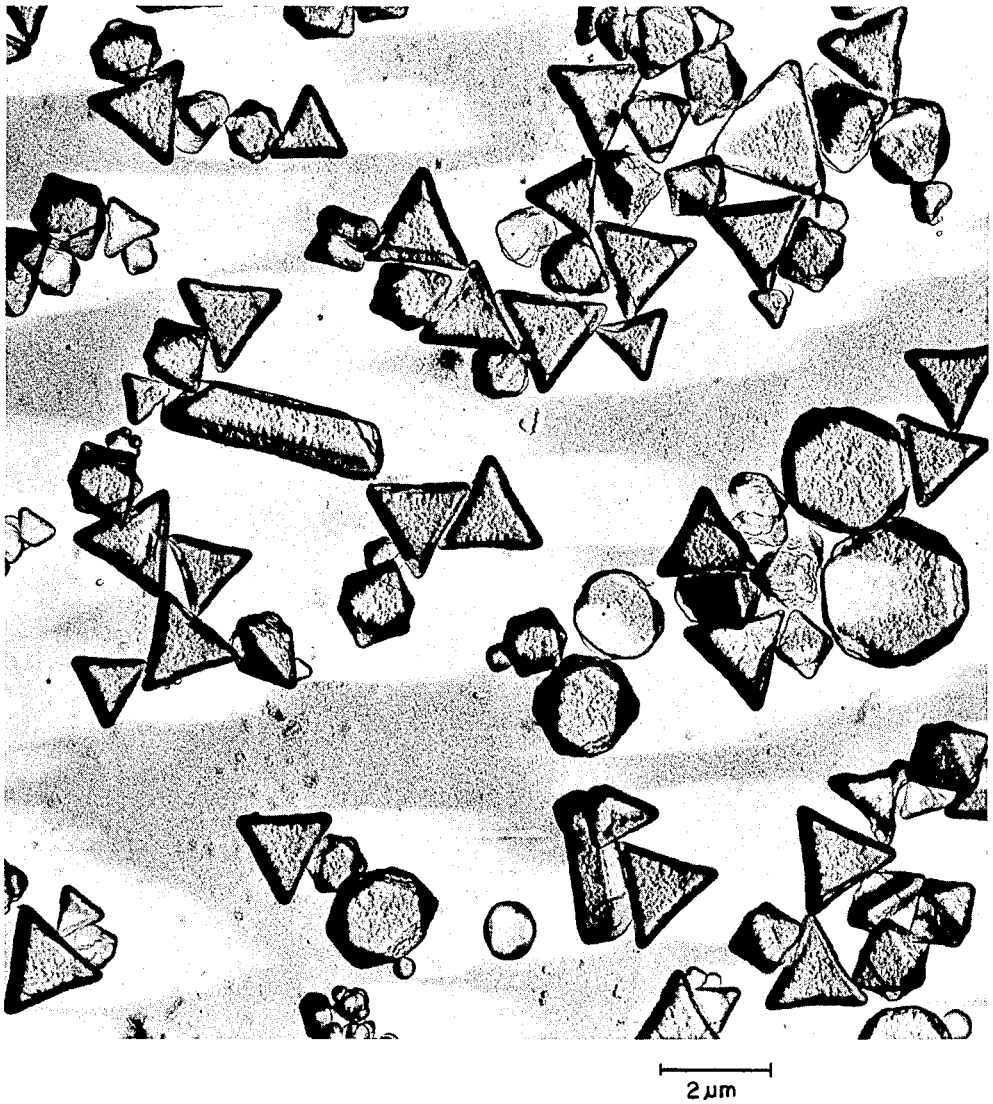
FIGS. 2 and 5 are electron micrographs of a control emulsion.

FIG. 2 is a shadowed electron micrograph showing the grains produced. From the length of the shadows it is apparent that the grains produced were roughly equal in thickness and effective circular diameter and thus were nontabular in character. The percent of the total grain projected area is reported in Table I as zero. The absence of tabular grains did not permit the Thickness, Mean ECD, and aspect Ratio columns of Table I to be completed.

Control 1E

AgClBr (0.5% Br) Comparison Emulsion

This emulsion was prepared as described in Control 1D, but with the $AgNO_3$ addition continued until a total of 0.2 mole Ag was consumed in the precipitation. Following an initial addition over a min period consuming 0.5% of the total Ag used, the addition rate was linearly accelerated over an additional period of 30 min (12× from start to finish) consuming 70.7% of the total Ag used in the precipitation. The addition rate then remained constant for 4.8 min until the final 28.8% of the total Ag was consumed.

The resulting emulsion was similar to the emulsion of Control 1D in containing nontabular grains.

Example 2

This example illustrates the preparation of tabular grain AgCl, AgClBr and AgClBrI emulsions by procedures similar to those of Example 1, but at a precipitation temperature of 55° C. Comparison examples using non-oxidized gelatin and, in one instance, using non-oxidized low methionine gelatin, are also included.

Example 2A

Tabular AgCl Emulsion

This emulsion was prepared identically to that of Example 1A, except for reduction of the initial adenine amount to 0.11 millimole and decrease of the precipitation temperature to 55° C. Further 0.074 millimole adenine additions were made after 2 min and 5 min of precipitation, and after 25 mL of $AgNO_3$ had been added.

The grain characteristics of the emulsion are summarized in Table I. The reduction in precipitation temperature resulted in thinning the tabular grains. While the average aspect ratio and tabular grain projected area declined, these could have been increased by extending the precipitation time.

Example 2B

Tabular AgClBr (1.0% Br) Emulsion

This emulsion 2B was prepared as described for Example 2B, except that 0.001 mole NaBr was added initially to the reaction vessel solution.

The grain characteristics of the emulsion are summarized in Table I. A marked reduction in tabular grain thickness was noted, resulting in a higher average tabular grain aspect ratio than reported for any previously described emulsion.

Example 2C

Tabular AgClBr (0.5% Br) Emulsion

This emulsion was prepared as described for Example 2B, but with the $AgNO_3$ addition continued until a total of 0.2 mole Ag was consumed in the precipitation. The sequence of $AgNO_3$ solution addition steps was similar to those described for Control 1E.

The grain characteristics of the emulsion are summarized in Table I. A significant increase in average tabular grain aspect ratio was realized.

Example 2D

Tabular AgClBr (0.5% Br) Emulsion made with 4-Aminopyrazolo[3,4-d]pyrimidine This emulsion was prepared as described for Example 2C, but as growth modifier adenine was replaced with the same molar amount of 4-aminopyrazolo[3,4-d]pyrimidine. A fourth 0.074 millimole growth modifier addition was made after 50 mL of $AgNO_3$ solution had been added.

The grain characteristics of the emulsion are summarized in Table I. This example establishes the feasibility of substituting an aminopyrazolopyrimidine for adenine in the preparation of the emulsions of this invention.

Example 2E

Tabular AgClBr (16 mole % Br) Emulsion

This emulsion was prepared as described for Example 2A, except that 0.016 mole NaBr was added initially to the reaction vessel solution.

Figure 3:
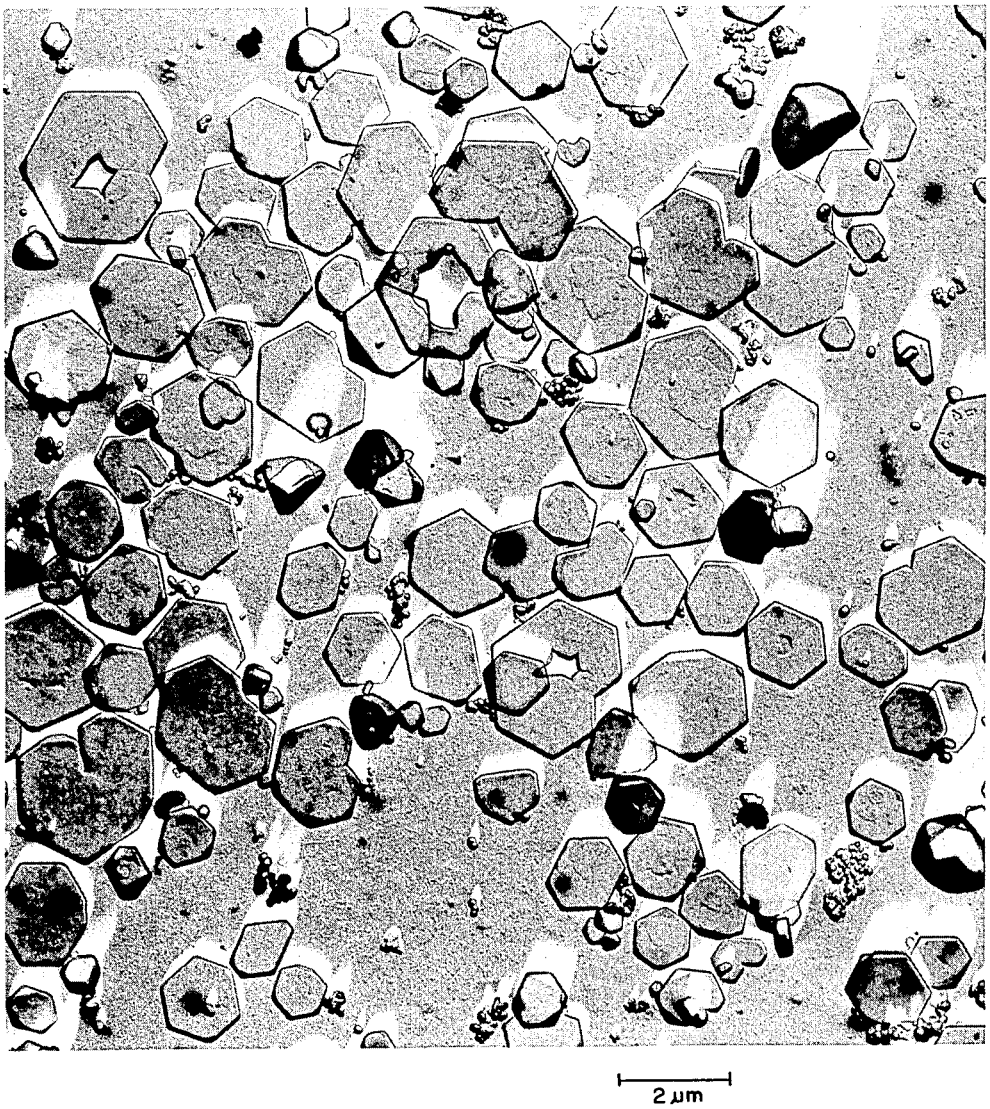

FIG. 3 is a carbon replica electron micrograph of the resulting tabular grain AgClBr (16 mole % Br) emulsion. The grain characteristics are summarized in Table I.

Example 2F

Tabular AgClBr (8% Br) Emulsion

This emulsion was prepared as described for Example 2E, but with the $AgNO_3$ addition continued until a total of 0.2 mole Ag was consumed in the precipitation. The sequence of $AgNO_3$ solution addition steps was similar to those described for Example 1E. A fourth 0.074 millimole addition of adenine was made after 50 mL of $AgNO_3$ solution had been added.

The grain characteristics are summarized in Table I.

Example 2G

Tabular AgClBr (58% Br) Emulsion

The reaction vessel, equipped with a stirrer, was charged with 400 g of an aqueous solution containing 1% of the oxidized gelatin, 0.001 mole NaBr, 0.11 millimole of adenine, and 0.5M in $CaCl_2$. The pH was adjusted to 4.0 at 55° C. and maintained at that value throughout the precipitation by addition of NaOH solution as required. A 2.0M $AgNO_3$ solution was added over a 2 min period at a rate consuming 1.0% of the total Ag used in the precipitation. The addition of $AgNO_3$ continued at a linearly accelerating rate over a period of 30 min (12× from start to finish). The addition then continued at the constant maximum rate until a total of 0.2 mole of $AgNO_3$ solution was exhausted. Beginning after 2 min a 4.59M solution of NaBr was simultaneously added at one-quarter the rate of $AgNO_3$ addition, until a total of 0.115 mole of NaBr solution was consumed. Further 0.074 millimole additions of adenine were made after 2 min and 5 min of the precipitation, and after 25 and 50 mL of $AgNO_3$ solution had been added.

The grain characteristics are summarized in Table I.

Example 2H

Tabular AgClBr (68% Br) Emulsion

This emulsion was prepared as described for Example 2G, but with the concentration of the NaBr solution added during the precipitation increased to 5.40M.

The grain characteristics are summarized in Table I.

Example 2I

Tabular AgClBrI (44/55/1%) Emulsion

This emulsion was prepared as described for Example 2G, but with the halide solution added during the precipitation 4.40M in NaBr and 0.080M in KI.

Figure 4:
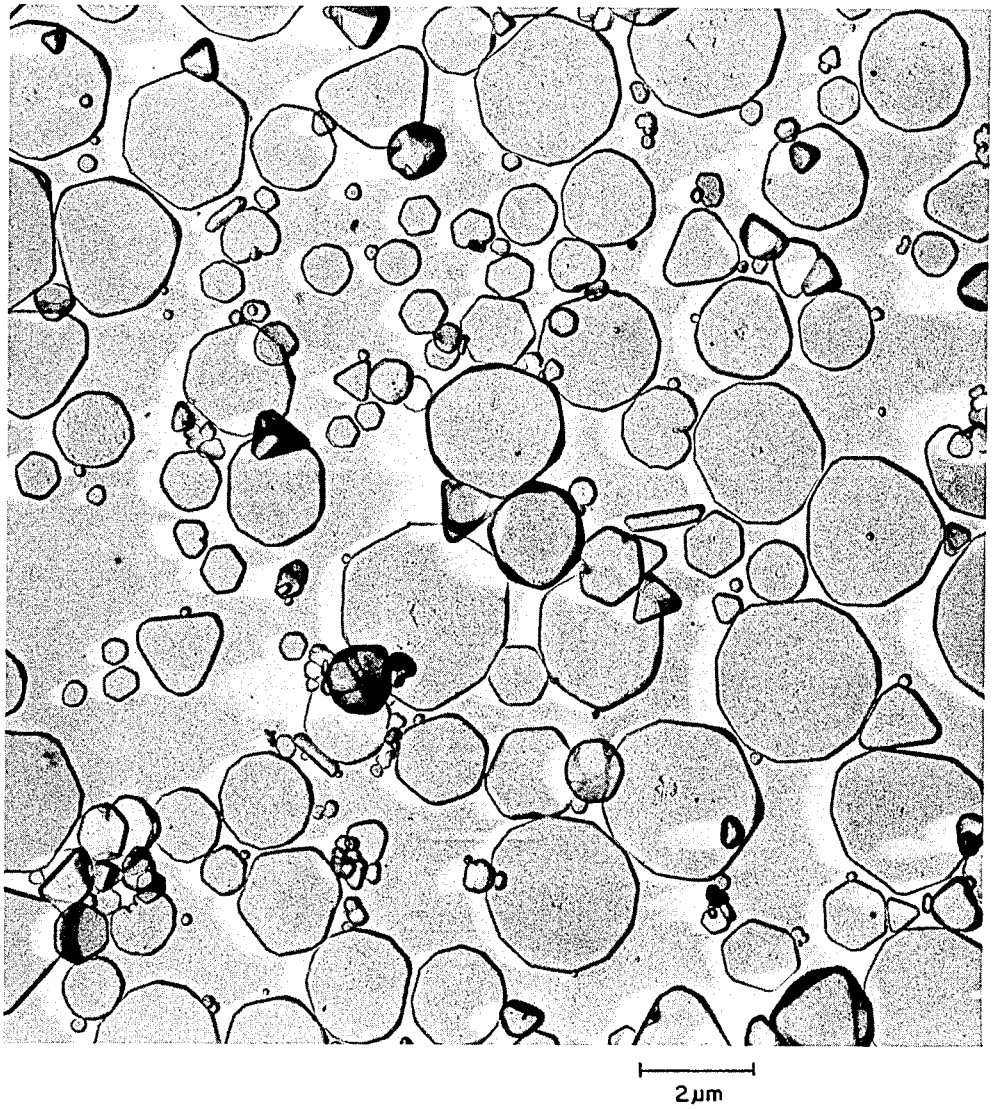

FIG. 4 is a carbon replica electron micrograph of the resulting tabular grain AgClBrI (44/55/1 mole %) emulsion. The grain characteristics are summarized in Table I.

Example 2J

Tabular AgCl Br (0.5% Br) Emulsion Using NaCl

This emulsion was prepared as described for Example 2C, but with the halide in the reaction vessel consisting of NaCl, at a concentration of 1.00M, in place of the $CaCl_2$. A further addition of 0.074 millimole of adenine was made after 50 mL of the $AgNO_3$ solution was added.

The grain characteristics are summarized in Table I.

Example 2K

Tabular AgClBr (1% Br) Emulsion Using Low Methionine Gelatin

The reaction vessel, equipped with a stirrer, was charged with 400 g of an aqueous solution containing 1% of a non-oxidized low methionine gelatin (4311-10060-19, 17 μmole methionine/g gelatin by analysis compared to a typical bone gelatin value of 56 μmole/g gelatin), 0.001 mole NaBr, 0.11 millimole of adenine, and 0.5M in $CaCl_2$. The pH was adjusted to 4.0 at 55° C. and maintained at that value throughout the precipitation. A 2.0M $AgNO_3$ solution was added over a 2 min period at a rate consuming 2.0% of the total Ag used in the precipitation. The addition of $AgNO_3$ was continued at a linearly accelerating rate over a period of 24 min (9.8× from start to finish) consuming the remaining 98% of the Ag used in the precipitation. A total of 0.1 mole Ag was consumed in the precipitation. Further 0.074 millimole additions of adenine were made after 2 min and 5 min of precipitation, and also after 25 mL of the $AgNO_3$ had been added.

The grain characteristics are summarized in Table I.

Control 2L

Tabular AgClBr (1% Br) Emulsion Using Non-oxidized Gelatin

This emulsion was prepared as described for Example 2K, but using a conventional deionized bone gelatin as peptizer.

The grain characteristics are summarized in Table I. Less than 50 percent of the total grain projected area was accounted for by tabular grains, and the mean tabular grain thickness was quite high, 0.56 μm.

Control 2M

Tabular AgClBr (0.5% Br) Emulsion Using Non-oxidized Gelatin

This emulsion was prepared as described for Example 2L, but with the $AgNO_3$ addition continued to consume a total of 0.2 mole Ag. The 2.0 M $AgNO_3$ solution was added over a 2 min period at a rate consuming 1.0% of the total Ag used in the precipitation. Addition was continued at a linearly accelerating rate over a period of 30 min (12× from start to finish). The addition then continued at the constant maximum rate until the total of 0.2 mole of $AgNO_3$ solution was exhausted. A further 0.074 millimole addition of adenine was made after 50 ml of the $AgNO_3$ solution had been added, in addition to the increments described in Example 2L.

Figure 5:
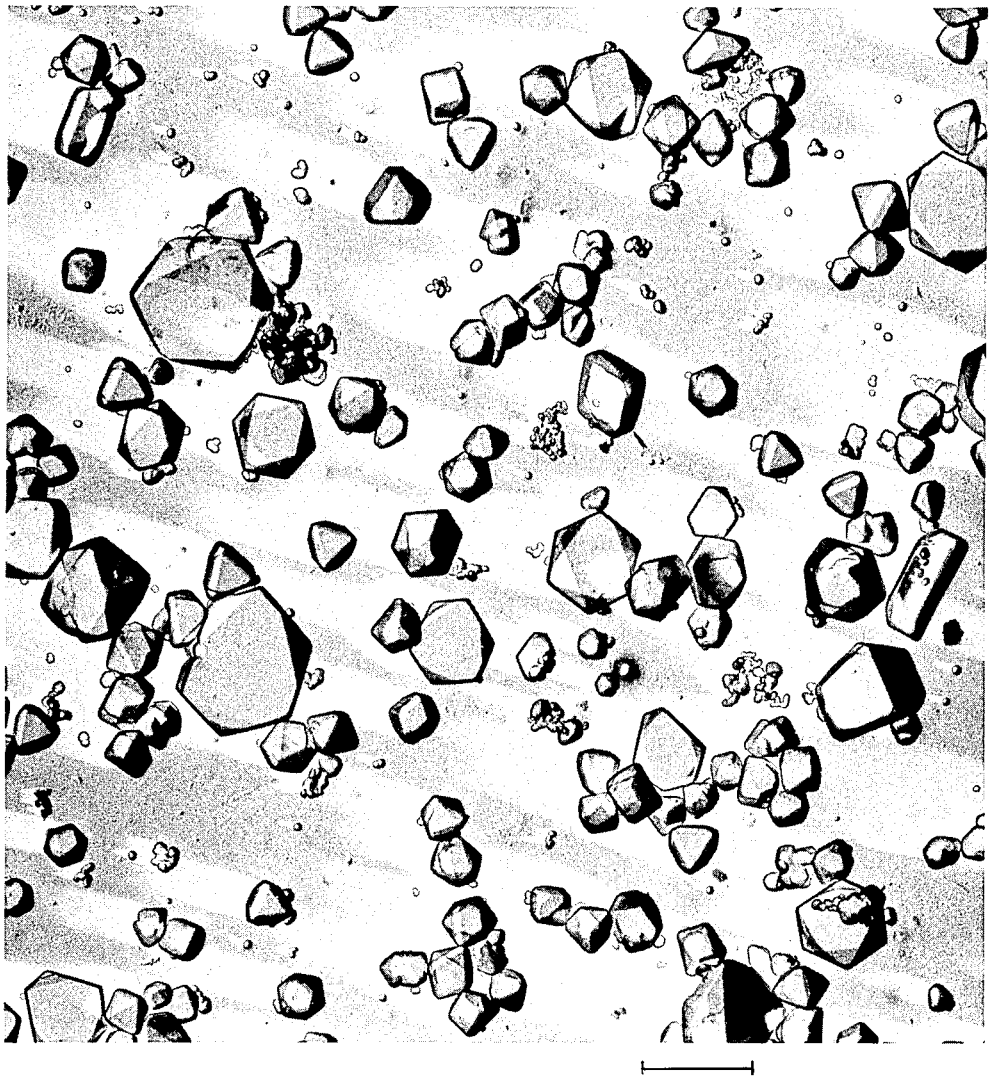

FIG. 5 is a carbon replica electron micrograph of the resulting tabular grain AgClBr (0.5 mole % Br). The grain characteristics are summarized in Table I. Less than 50 percent of the total grain projected area was accounted for by tabular grains, and the mean tabular grain thickness was quite high, 0.59 μm.

Example 2N

Tabular AgClBr (54% Br) Emulsion-Increased Reactor Br and Delayed Run Br

The reaction vessel, equipped with a stirrer, was charged with 400 g of an aqueous solution containing 1% of oxidized gelatin, 0.016 mole NaBr, 0.11 millimole of adenine, and 0.5M in $CaCl_2$. The pH was adjusted to 4.0 at 55° C. and maintained at that value throughout the precipitation. A 2.0M $AgNO_3$ solution was added over a 2 min period at a rate consuming 1.0% of the total Ag used in the precipitation. The addition of $AgNO_3$ was continued at a linearly accelerating rate over a period of 30 min (12× from start to finish). The addition of $AgNO_3$ then continued at the constant maximum rate until a total of 0.2 mole of $AgNO_3$ solution was exhausted. After 16 mL of the $AgNO_3$ had been added, addition was begun of 3.82M NaBr solution at one-quarter the low rate of the $AgNO_3$ solution addition, until 0.092 mole NaBr had been added during the precipitation. Further additions of 0.074 millimole of adenine each were made after 2 min and 5 min of the precipitation, and after 25 mL and 50 mL of $AgNO_3$ had been added.

The grain characteristics are summarized in Table I. The tabular grains were exceptionally thin, less than 0.2 μm.

Example 3

This example illustrates the preparation of a tabular grain AgClBr (1% Br, and 0.5% Br) emulsions at 40° C.

Example 3A

Tabular AgClBr (1% Br) Emulsion

The reaction vessel, equipped with a stirrer, was charged with 400 g of an aqueous solution containing 1% of oxidized gelatin, 0.001 mole NaBr, 0.11 millimole adenine, and 0.5M in $CaCl_2$. The pH was adjusted to 4.0 at 40° C. and maintained at that value throu.ghout the precipitation. A 2.0M $AgNO_3$ solution was added over a 1 min period at a rate consuming 1.0% of the total Ag used in the precipitation. The addition of $AgNO_3$ was continued at a linearly accelerating rate (9.8× from start to finish) over an additional period of 24 min, during which time the remaining 99% of the total Ag was added. A total of 0.1 mole Ag was consumed in the precipitation. Concurrently with the $AgNO_3$ solution, a 0.0188M aqueous solution of adenine was added at one-quarter the flow rate of the $AgNO_3$ solution.

The grain characteristics are summarized in Table I. The tabular grains were exceptionally thin, less than 0.1 μm.

Example 3B

Tabular AgClBr (0.5% Br) Emulsion

The reaction vessel, equipped with a stirrer, was charged with 400 g of an aqueous solution containing 1.5% of oxidized gelatin, 0.001 mole NaBr, 0.26 millimole adenine, and 0.5M in $CaCl_2$. The pH was adjusted to 4.0 at 40° and maintained at that value throughout the precipitation. A 2.0M $AgNO_3$ solution was added over a 1 min period at a rate consuming 0.5% of the total Ag used in the precipitation. The addition of $AgNO_3$ was continued at a linearly accelerating rate over a period of 30 min (12× from start to finish). The addition of $AgNO_3$ then continued at the constant maximum rate until a total of 0.2 mole of $AgNO_3$ solution was exhausted. Further additions of 0.074 millimole of adenine each were made after 2 min and 5 min of the precipitation, and after 25 mL of $AgNO_3$ had been added.

The grain characteristics are summarized in Table I.

Example 4

This example illustrates the preparation of a tabular grain AgBr emulsion in a reactor which is 0.5M in chloride.

Example 4A

Tabular AgBr Emulsion

The reaction vessel, equipped with a stirrer, was charged with 400 g of an aqueous solution containing 1% of oxidized gelatin, 0.001 mole NaBr, 0.11 millimole adenine, and 0.5M in $CaCl_2$. The pH was adjusted to 4.0 at 55° C. and maintained at that value throughout the precipitation.

A 2.0M solution of $AgNO_3$ was added over a 1 min period at a rate consuming 1.0% of the total Ag used in the precipitation. The addition of $AgNO_3$ was continued over a period of 30 min at a linearly accelerating rate (12× from start ing 70.7% of the total Ag used and then at the maximum constant rate until the total of 0.2 mole of $AgNO_3$ solution was exhausted. A 2M NaBr solution was added concurrently with the $AgNO_3$ solution and at the same flow rates. Further 0.074 millimole additions of adenine were made after 2 min and 5 min of the precipitation, and after 25 mL and 50 mL of the $AgNO_3$ solution had been added.

Figure 6:
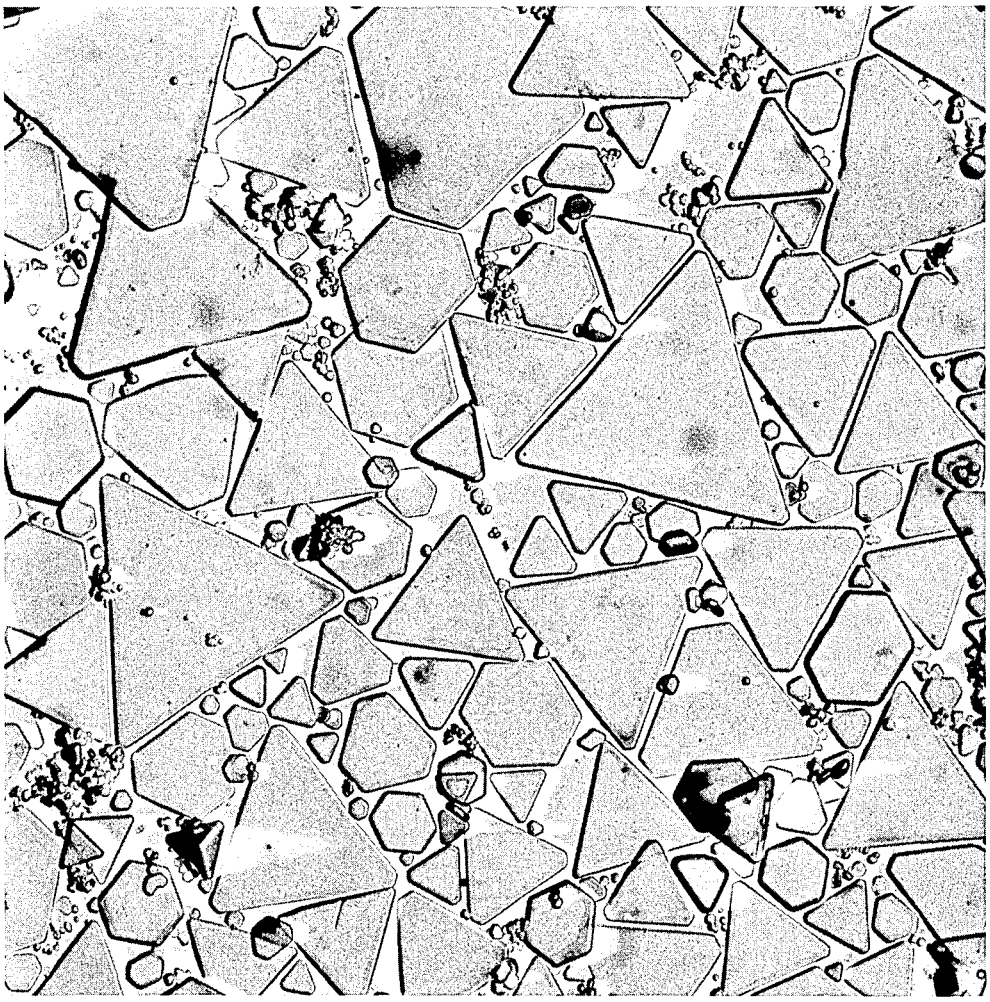

FIG. 6 is a carbon replica electron micrograph of the resulting emulsion. The grain characteristics are summarized in Table I.

TABLE I

| | | Emulsion Dimensions | | | | | | |
|---|---|---|---|---|---|---|---|---|
| Emulsion | Identification | AgBr Mole % | AgI Mole % | Pption T °C. | Thickness mμ | Mean ECD | Aspect Ratio | % Of Area Tabular |
| 1A | Example | 0 | 0 | 70 | 0.32 | 5.0 | 15.6:1 | 75 |
| 1B | Example | 1.0 | 0 | 70 | 0.27 | 4.3 | 15.9:1 | 80 |
| 1C | Example | 58.5* | 0 | 70 | 0.29 | 3.7 | 12.8:1 | 80 |
| 1D | Control | 1.0 | 0 | 70 | — | — | — | ≃0 |
| 1E | Control | 0.5 | 0 | 70 | — | — | — | ≃0 |
| 2A | Example | 0 | 0 | 55 | 0.30 | 3.0 | 10:1 | 60 |
| 2B | Example | 1.0 | 0 | 55 | 0.18 | 3.0 | 17.6:1 | 70 |
| 2C | Example | 0.5 | 0 | 55 | 0.20 | 4.2 | 21.0:1 | 80 |
| 2D | Example | 0.5 | 0 | 55 | 0.26 | 3.7 | 14.2:1 | 75 |
| 2E | Example | 16 | 0 | 55 | 0.13 | 2.5 | 19.2:1 | 70 |
| 2F | Example | 8 | 0 | 55 | 0.19 | 3.3 | 17.4:1 | 75 |
| 2G | Example | 58* | 0 | 55 | 0.25 | 3.8 | 15.2:1 | 80 |
| 2H | Example | 68* | 0 | 55 | 0.22 | 3.7 | 16.8:1 | 80 |
| 2I | Example | 55* | 1.0* | 55 | 0.26 | 2.5 | 9.6:1 | 70 |
| 2J | Example | 0.5 | 0 | 55 | 0.23 | 3.7 | 16.1:1 | 75 |
| 2K | Example | 1.0 | 0 | 55 | 0.34 | 2.8 | 8.2:1 | 75 |
| 2L | Control | 1.0 | 0 | 55 | 0.56 | 2.2 | 3.9:1 | <50 |
| 2M | Control | 0.5 | 0 | 55 | 0.59 | 2.8 | 4.7:1 | <50 |
| 2N | Example | 54* | 0 | 55 | 0.17 | 2.7 | 15.9:1 | 65 |
| 3A | Example | 1.0 | 0 | 40 | 0.09 | 2.0 | 22.2:1 | 50 |
| 3B | Example | .05 | 0 | 40 | 0.17 | 2.5 | 14.7:1 | 80 |
| 4A | Example | 100 | 0 | 55 | 0.15 | 3.0 | 20:1 | 75 |

*Single grain x-ray dispersive energy analyses of these emulsions showed halide ratios in substantial agreement with those calculated from the bromide and/or iodide additions.

The invention has been described in detail with particular reference to preferred embodiments thereof, but it will be understood that variations and modifications can be effected within the spirit and scope of the invention.

What is claimed is:

1. A process of preparing a radiation sensitive high aspect ratio tabular grain emulsion, wherein tabular grains of less than 0.35 μm in thickness and an aspect ratio of greater than 8:1 account for greater than 50 percent of the total grain projected area, comprising introducing silver ion into a dispersing medium containing at least a 0.5 molar concentration of chloride ion and a gelatino-peptizer formed of less than 30 micromoles of methionine per gram.

2. A process of preparing a radiation sensitive high aspect ratio tabular grain emulsion according to claim 1 wherein the dispersing medium contains chloride ion in a concentration range of from 0.5 to 2.0 molar.

3. A process of preparing a radiation sensitive high aspect ratio tabular grain emulsion according to claim 2 wherein the dispersing medium contains chloride ion in the concentration range of from 0.5 to 1.5 molar.

4. A process of preparing a radiation sensitive high aspect ratio tabular grain emulsion according to claim 1 wherein halide ion is introduced into the dispersing medium concurrently with the silver ion.

5. A process of preparing a radiation sensitive high aspect ratio tabular grain emulsion according to claim 4 wherein chloride ion is introduced into the dispersing medium concurrently with the silver ion.

6. A process of preparing a radiation sensitive high aspect ratio tabular grain emulsion according to claim 4 wherein bromide ion is introduced into the dispersing medium concurrently with the silver ion.

7. A process of preparing a radiation sensitive high aspect ratio tabular grain emulsion according to claim 4 wherein a minor amount of iodide ion is added to the dispersing medium concurrently with the silver ion.

8. A process of preparing a radiation sensitive high aspect ratio tabular grain emulsion according to claim 7 wherein less than 1 mole percent iodide, based on the silver ion, is added to the dispersing medium.

9. A process of preparing a radiation sensitive high aspect ratio tabular grain emulsion according to claim 1 wherein bromide ion is added to the dispersing medium prior to the silver ion.

10. A process of preparing a radiation sensitive high aspect ratio tabular grain emulsion according to claim 7 wherein at least a $2.5\times10^{-3}$ molar concentration of bromide ion is present in the dispersing medium prior to addition of the silver ion.

11. A process of preparing a radiation sensitive high aspect ratio tabular grain emulsion according to claim 1 wherein a growth modifier is introduced into the dispersing medium.

12. A process of preparing a radiation sensitive high aspect ratio tabular grain emulsion according to claim 11 wherein the growth modifier is introduced into the dispersing medium in a concentration of from 0.1 to $10^{-4}$ mole per silver mole.

13. A process of preparing a radiation sensitive high aspect ratio tabular grain emulsion according to claim 12 wherein an aminoazaindene is employed as the growth modifier.

14. A process of preparing a radiation sensitive high aspect ratio tabular grain emulsion according to claim 13 wherein adenine is employed as a growth modifier.

15. A process of preparing a radiation sensitive high aspect ratio tabular grain emulsion according to claim 14 wherein the adenine is employed in the dispersing medium in a concentration range of from $0.5\times10^{-3}$ mole per silver mole.

16. A process of preparing a radiation sensitive high aspect ratio tabular grain emulsion according to claim 1 wherein the gelatino-peptizer employed contains less than 12 micromoles of methionine per gram.

17. A process of preparing a radiation sensitive high aspect ratio tabular grain silver chloride emulsion, wherein tabular grains of less than 0.35 μm in thickness and an aspect ratio of greater than 8:1 account for greater than 50 percent of the total grain projected area, comprising introducing silver ion into a dispersing medium containing a gelatino-peptizer formed of less than 12 micromoles of methionine per gram, maintaining at least a 0.5 molar concentration of chloride ion in the dispersing medium, and maintaining the dispersing medium free of other halide ions.

18. A process of preparing a radiation sensitive high aspect ratio tabular grain silver chlorobromide emulsion optionally containing up to 1 mole percent iodide, based on silver, wherein tabular grains of less than 0.20 μm in thickness aspect ratio of greater than 12:1 account for greater than 70 percent of the total grain projected area, comprising introducing silver ion and up to 1 mole percent iodide ion, based on silver, into a dispersing medium containing at least a $2.5\times10^{-3}$ molar concentration of bromide ion and a gelatino-peptizer formed of less than 12 micromoles of methionine per gram and maintaining at least a 0.5 molar concentration of chloride ion in the dispersing medium.

19. A process of preparing a radiation sensitive high aspect ratio tabular grain silver bromide emulsion optionally containing up to 1 mole percent iodide, based on silver, wherein tabular grains of less than 0.20 μm in thickness and an aspect ratio of greater than 12:1 account for greater than 70 percent of the total grain projected area, comprising providing a dispersing medium containing a gelatino-peptizer formed of less than 12 micromoles of methionine per gram, at least a 0.5 molar concentration of chloride ion, and at least a $2.5\times10^{-3}$ molar concentration of bromide ion and introducing silver ion, bromide ion, and up to 1 mole percent iodide ion, based on silver, into the dispersing medium.

20. A radiation sensitive high aspect ratio tabular grain emulsion comprised of a gelatino-peptizer and silver halide grains which are at least 40 mole percent chloride, based on silver, at least 50 percent of the total projected area of said silver halide grains being accounted for by tabular grains having a thickness of less than 0.35 μm and an aspect ratio of greater than 8:1.

21. A radiation sensitive high aspect ratio tabular grain emulsion according to claim 20 wherein at least 50 percent of the total projected area of said silver halide grains is accounted for by tabular grains having a thickness of less than 0.3 μm and an aspect ratio of greater than 8:1.

22. A radiation sensitive high aspect ratio tabular grain emulsion according to claim 21 wherein at least 50 percent of the total projected area of said silver halide grains is accounted for by tabular grains having a thickness of less than 0.2 μm and an aspect ratio of greater than 8:1.

23. A radiation sensitive high aspect ratio tabular grain emulsion according to claim 20 wherein at least 50 percent of the total projected area of said silver halide grains is accounted for by tabular grains having a thickness of less than 0.35 μm and an aspect ratio of greater than 12:1.

24. A radiation sensitive high aspect ratio tabular grain emulsion according to claim 20 wherein at least 70 percent of the total projected area of said silver halide grains is accounted for by tabular grains having a thickness of less than 0.35 μm and an aspect ratio of greater than 8:1.

25. A radiation sensitive high- aspect ratio tabular grain emulsion according to claim 20 wherein said tabular grains are comprised of from 40 to 50 mole percent chloride, based on silver.

26. A radiation sensitive high aspect ratio tabular grain emulsion according to claim 10 wherein said tabular grains are comprised of greater than 50 mole percent chloride, based on silver.

27. A radiation sensitive high aspect ratio tabular grain emulsion comprised of a gelatino-peptizer and silver chloride grains, at least 50 percent of the total projected area of said silver chloride grains being accounted for by tabular grains having a thickness of less than 0.35 μm and an aspect ratio of greater than 8:1.

28. A radiation sensitive high aspect ratio tabular grain emulsion comprised of a gelatino-peptizer and silver chlorobromide grains, at least 70 percent of the total projected area of said silver chlorobromide grains being accounted for by tabular grains having a thickness of less than 0.2 μm and an aspect ratio of greater than 12:1.

29. A radiation sensitive high aspect ratio tabular grain emulsion comprised of a gelatino-peptizer and silver chlorobromoiodide grains, at least 70 percent of the total projected area of said silver chlorobromoiodide grains being accounted for by tabular grains having a thickness of less than 0.2 μm and an aspect ratio of greater than 12:1.

30. A radiation sensitive high aspect ratio tabular grain emulsion according to claim 29 in which iodide accounts for less than 1 mole percent, based on silver.

* * * * *